US010610079B2

(12) United States Patent
Gursoy et al.

(10) Patent No.: US 10,610,079 B2
(45) Date of Patent: Apr. 7, 2020

(54) DISHWASHER HAVING MULTIPLE SPRAY ARMS FOR IMPROVED WASHING EFFECTIVENESS

(71) Applicant: ARCELIK ANONIM SIRKETI, Istanbul (TR)

(72) Inventors: Hasret Gursoy, Isanbul (TR); Orhan Atabey, Istanbul (TR); Uygar Unverdi, Istanbul (TR); Fatih Basaran, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 631 days.

(21) Appl. No.: 14/911,004

(22) PCT Filed: Jul. 25, 2014

(86) PCT No.: PCT/EP2014/066079
§ 371 (c)(1),
(2) Date: Feb. 8, 2016

(87) PCT Pub. No.: WO2015/018671
PCT Pub. Date: Feb. 12, 2015

(65) Prior Publication Data

US 2016/0192818 A1 Jul. 7, 2016

(30) Foreign Application Priority Data

Aug. 6, 2013 (TR) ..... 2013 09559

(51) Int. Cl.
*A47L 15/23* (2006.01)

(52) U.S. Cl.
CPC ..... *A47L 15/23* (2013.01)

(58) Field of Classification Search
None
See application file for complete search history.

(56) References Cited

U.S. PATENT DOCUMENTS 3,288,155 A * 11/1966 Swetnam ..... A47L 15/23 134/176
3,876,148 A 4/1975 Cushing et al.
(Continued)

FOREIGN PATENT DOCUMENTS

DE 29718777 U1 3/1998
EP 0727177 A2 8/1996
(Continued)

OTHER PUBLICATIONS

International Search Report of PCT/EP2014/066079 and the references cited therein.

(Continued)

*Primary Examiner* — Rita P Adhlakha
(74) *Attorney, Agent, or Firm* — Kilpatrick Townsend & Stockton LLP

(57) ABSTRACT

The present invention relates to a dishwasher (1) comprising a tub (2) having a base (3), a rear wall (4) and two side walls (5) surrounding the base (3); a door (6) providing access to the tub (2), connected to the tub (2) from its lower side and opening by tilting forward; a rack (7) having a washing position wherein it is placed on the base (3) so as to entirely remain inside the tub (2) and a loading position wherein it is positioned on the inner surface of the door (6) by being moved forward when the door (6) is open and wherein loading-unloading can be performed; and a spray arm (8) that extends from the base (3) into the tub (2), that remains under the rack (7) when the rack (7) is in the washing position and that sprays water into the rack (7) by rotating around itself.

15 Claims, 6 Drawing Sheets

(56) References Cited

U.S. PATENT DOCUMENTS

Figure 1:
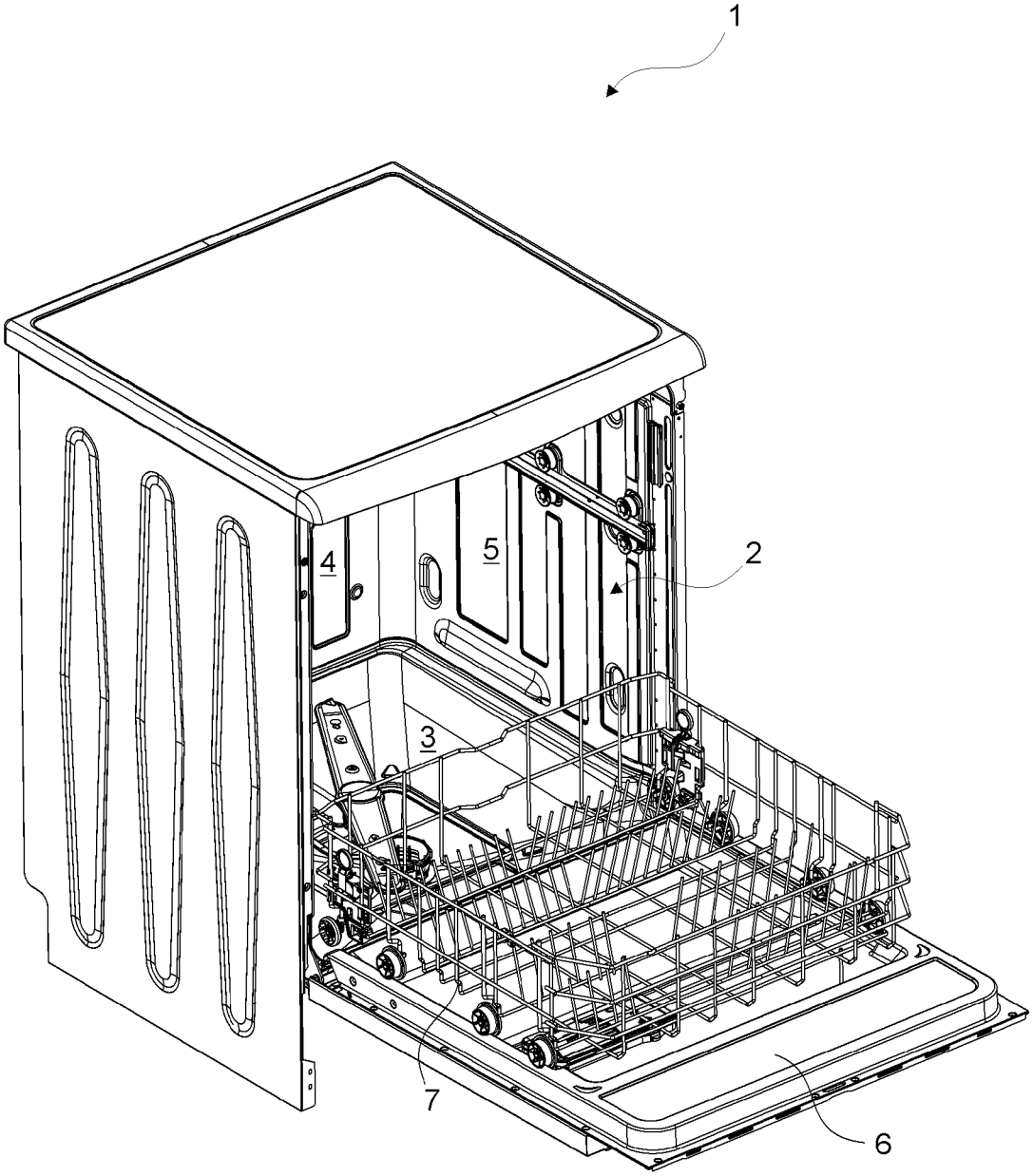

| | | | | |
|---|---|---|---|---|
| 8,485,205 | B2 * | 7/2013 | Fountain | A47L 15/22 134/172 |
| 2013/0139860 | A1 | 6/2013 | Forster et al. | |
| 2013/0255733 | A1 * | 10/2013 | Ju | A47L 15/23 134/179 |

FOREIGN PATENT DOCUMENTS

| | | | |
|---|---|---|---|
| EP | 1549196 | A1 | 7/2005 |
| EP | 1586264 | A2 | 10/2005 |
| EP | 1549195 | B1 | 11/2011 |
| EP | 2399499 | A1 | 12/2011 |
| EP | 2687141 | A1 | 1/2014 |
| KR | 100258616 | B1 | 7/2000 |
| WO | 2004019747 | A1 | 3/2004 |

OTHER PUBLICATIONS

Written Opinion of the International Search Authority for PCT/EP2014/066079 and the references cited therein.

* cited by examiner

DISHWASHER HAVING MULTIPLE SPRAY ARMS FOR IMPROVED WASHING EFFECTIVENESS

RELATED APPLICATIONS

This application is a U.S. National Phase of International Application No. PCT/EP2014/066079, filed Jul. 25, 2014, claiming priority to Turkish Patent Application No. 2013/09559, filed Aug. 6, 2013, contents of which are hereby incorporated by reference in their entirety.

The present invention relates to a dishwasher, the washing effectiveness of which is improved.

Dishwashers generally comprise upper and lower racks which are placed inside the washing tub and wherein the kitchenware items such as pots, plates etc. are placed. Each rack is moved outwards from the washing tub, enabling the loading of the kitchenware items into the rack or the unloading from the rack.

A spray arm, connected to the water line, is disposed under each rack which sprays water onto the objects placed in the rack by rotating around itself. In the state of the art, additional spray arms in the vicinity of the spray arm are used, that spray extra water to the region in the rack where extensively dirty dishes with respect to the others are placed, thus enabling the said region to be effectively washed. However, the said additional spray arms cannot spray the said region efficiently. Moreover, additional spray arms with complex structures increase the production costs.

In the state of the art European Patent Application No. EP1549196, a dishwasher is disclosed, having a nozzle that extends from the side of the spray arm and that sprays water to a region of the rack situated thereabove.

The aim of the present invention is the realization of a dishwasher, the washing effectiveness of which is improved.

The dishwasher, realized in order to attain the aim of the present invention, explicated in the first claim and the respective claims thereof, comprises an additional spray arm that is disposed under the spray arm, that extends almost parallel to the base plane, that can rotate around its axis for a limited distance as a result of the pressure of the water pumped thereinto and that sweeps a region of the rack with water.

In an embodiment of the present invention, the additional spray arm comprises a transfer means that extends outwards from the rotational axis and almost parallel to the base and that is situated so as to at least partially rotate around the axis whereto it is connected, and a headpiece that is situated at the end of the transfer means so as to rotate almost completely around its axis and that sprays the water received from the transfer means to the rack.

In an embodiment of the present invention, the additional spray arm comprises a hole that is arranged on the transfer means so as to partially spray the water inside the transfer means to the right or left side of the transfer means, that faces the right or left side of the transfer means and that enables the transfer means to move in the reverse direction compared to the said sprayed water. By means of the hole spraying water to the left side of the additional spray arm, the transfer means rotates towards the right in accordance with the action-reaction principle. The said rotation accelerates depending on the pressure of the water.

In a derivative of this embodiment, the spray arm comprises an outlet that enables the water inside the spray arm to be partially sprayed onto the additional spray arm so that the additional spray arm partially rotates around its axis in the horizontal plane. The additional spray arm, rotating for a certain angle with the water sprayed through the hole on the transfer means, returns to its initial position after the water, that is sprayed through the outlet while the spray arm rotates with the pumping of water into the spray arm, hits the additional spray arm and pushes the additional spray arm.

In a derivative of this embodiment, the spray arm comprises two arms that are situated on the spray arm, that extend in different directions and spray water into the rack. The outlet on the arm almost directly faces the base so as to spray water to the additional spray arm. While rotating with the water sprayed through the hole, the additional spray arm sweeps almost half of the rack with the water sprayed through the headpiece situated thereon and returns to its initial position by means of the water sprayed through the outlet.

In an embodiment of the present invention, the dishwasher comprises a valve that is situated on the water line pumping water to the spray arm and the additional spray arm and that enables water to be transferred to the spray arm and/or the additional spray arm. By means of the valve, water line supplies water to the spray arm or the additional spray arm as desired.

In an embodiment of the present invention, the additional spray arm comprises at least two spraying holes that are situated on the headpiece, that enable water to be sprayed from the headpiece to the rack, that enable the headpiece to rotate around its axis while spraying water into the rack and that face opposite directions.

In an embodiment of the present invention, the additional spray arm comprises a barrier that is situated on the transfer means, that extends upwards from the transfer means and that, with the effect of the water sprayed through the outlet contacting thereon, enables the additional spray arm to rotate. The additional spray arm easily rotates by means of the barrier that is situated at the upper portion of the transfer means and that converts the force of the water sprayed through the outlet to torque with its height and distance to the center whereto the transfer means is connected.

In an embodiment of the present invention, the dishwasher comprises at least one protrusion that is situated on the spray arm and a gear rack that is situated on the transfer means and that enables the transfer means to rotate with the protrusion contacting thereon during the rotation of the spray arm. The additional spray arm, that rotates for a certain distance by means of the water sprayed through the hole arranged on the transfer means, returns to its initial position with the protrusions contacting the gear rack during the rotation of the spray arm.

In an embodiment of the present invention, the spray arm and the additional spray arm do not work simultaneously. While transferring water to the additional spray arm, the valve stops water transfer to the spray arm. After the additional spray arm partially sweeps the rack with water, the valve cuts water transfer to the additional spray arm and transfer water to the spray arm.

In an embodiment of the present invention, the dishwasher comprises a stopper that enables the rotational movement of the additional spray arm to be terminated after the additional spray arm bears thereon. The rotational movement of the additional spray arm ends as the additional spray arm hits the stopper. In the dishwasher, two stoppers are used with a distance therebetween, that limit the rotational movement of the additional spray arm in both directions.

By means of the present invention, a dishwasher is realized, wherein more water is sprayed to the region of the rack where extensively dirty dishes with respect to the others are placed and thus the said region is cleaned in a more effective manner.

A dishwasher realized in order to attain the aim of the present invention is illustrated in the attached figures, where:

FIG. 1—is the perspective view of a dishwasher when the rack is in the loading position.

Figure 2:
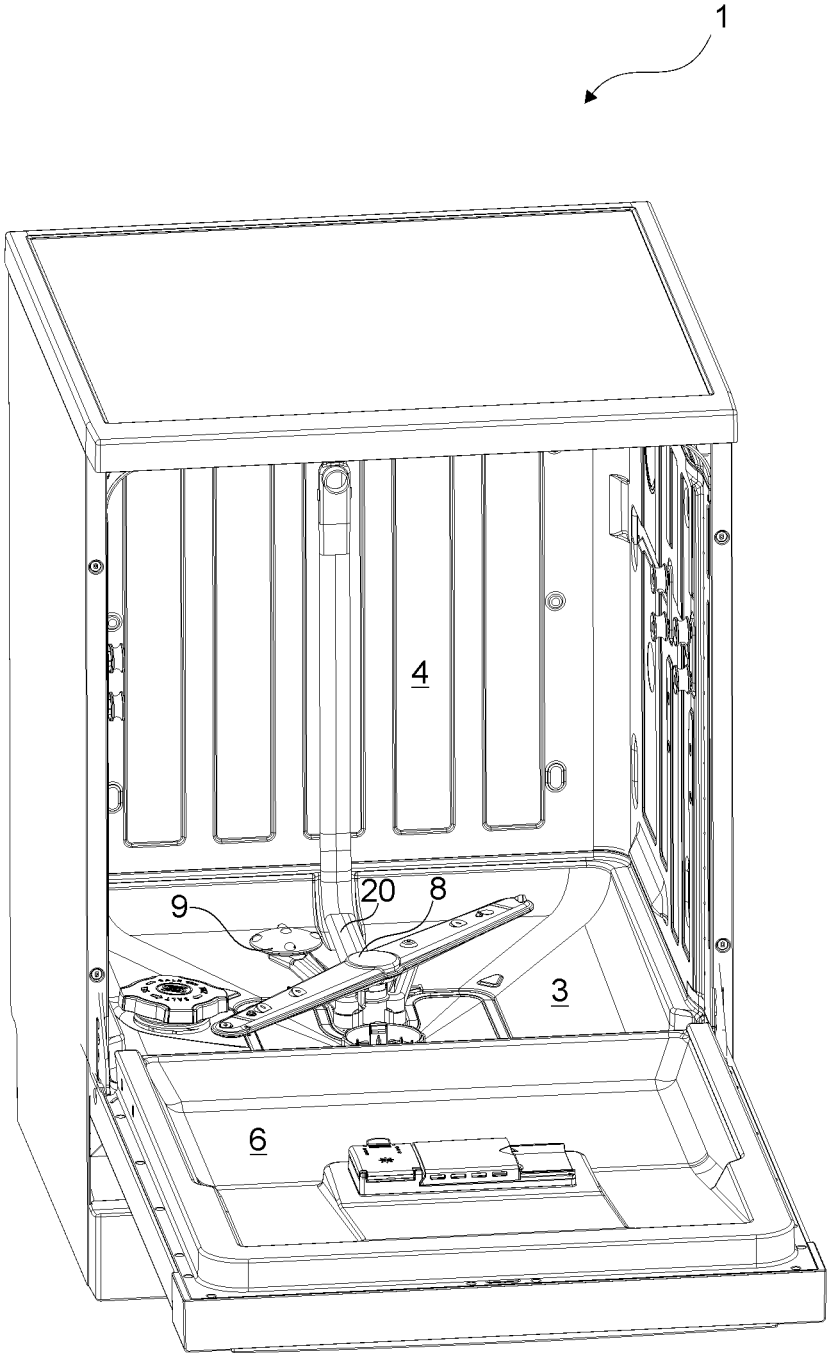

FIG. 2—is the perspective view of the dishwasher while the door thereof is open in an embodiment of the present invention.

Figure 3:
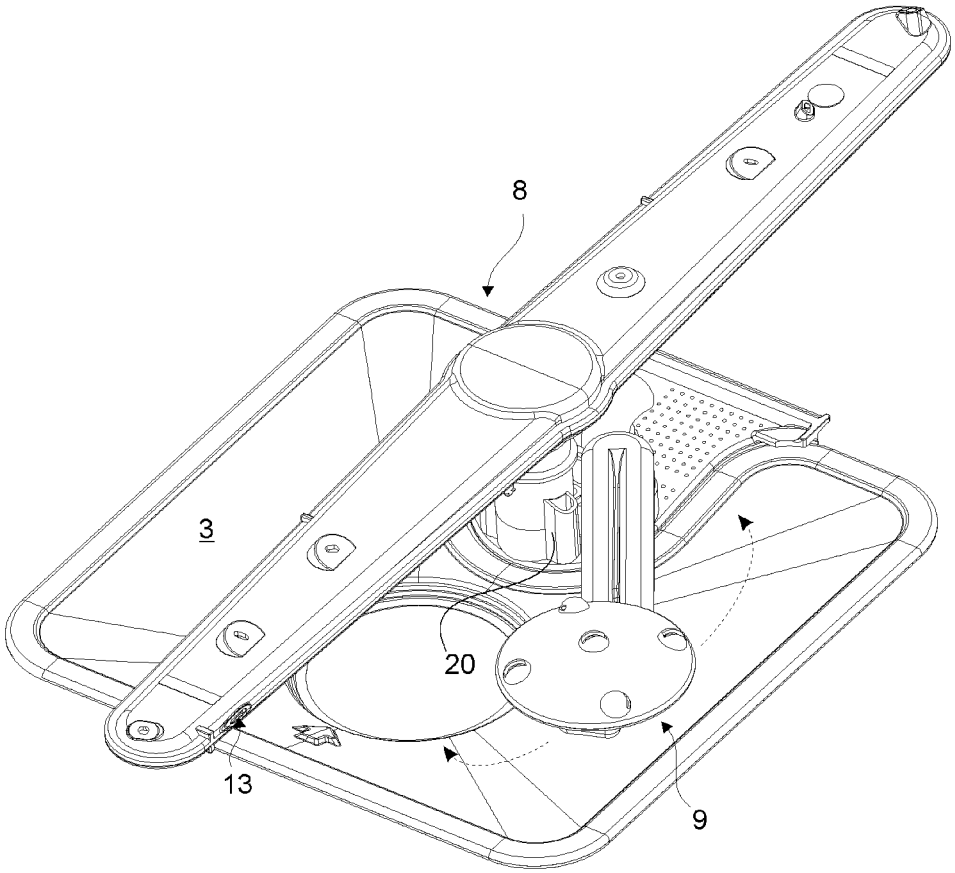

FIG. 3—is the perspective view of the spray arm and the additional spray arm related to an embodiment of the present invention.

Figure 4:
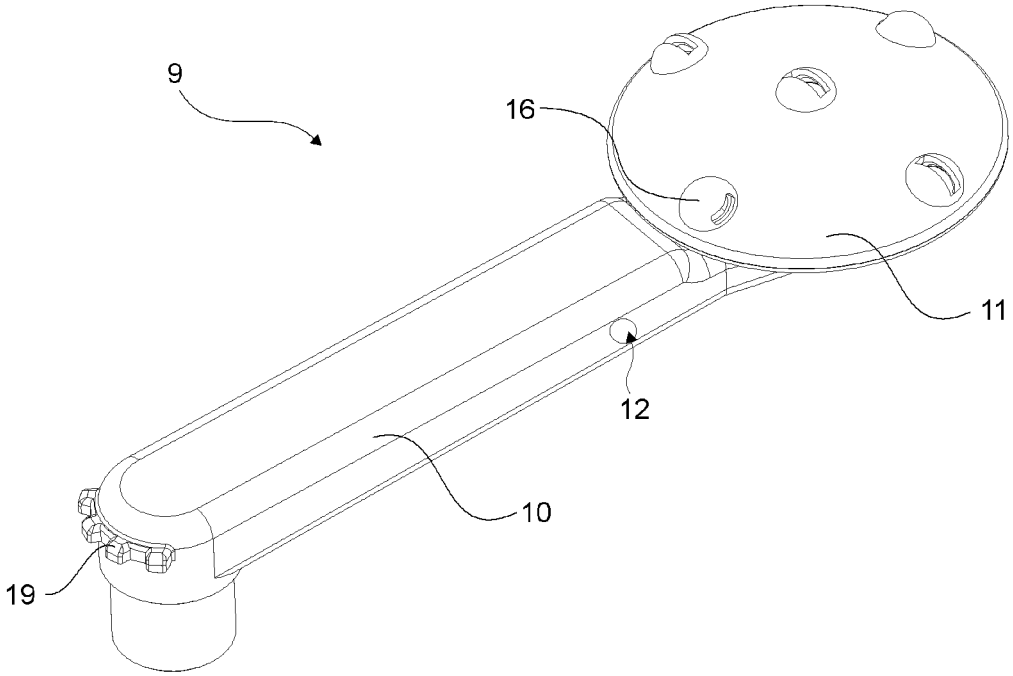

FIG. 4—is the perspective view of the additional spray arm related to an embodiment of the present invention.

Figure 5:
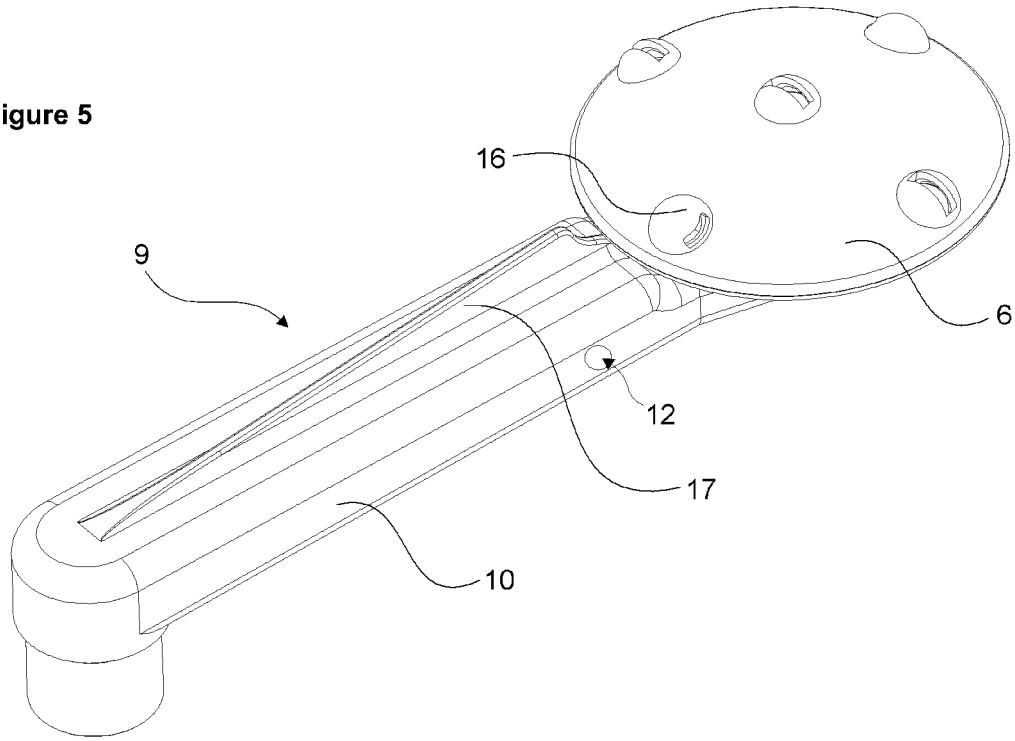

FIG. 5—is the perspective view of the additional spray arm related to an embodiment of the present invention.

Figure 6:
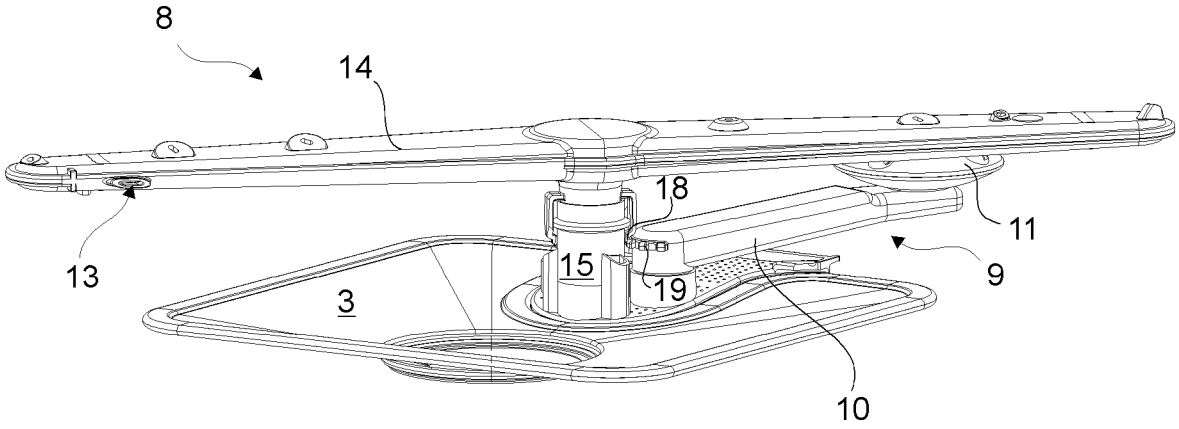

FIG. 6—is the perspective view of the spray arm and the additional spray arm related to an embodiment of the present invention.

Figure 7:
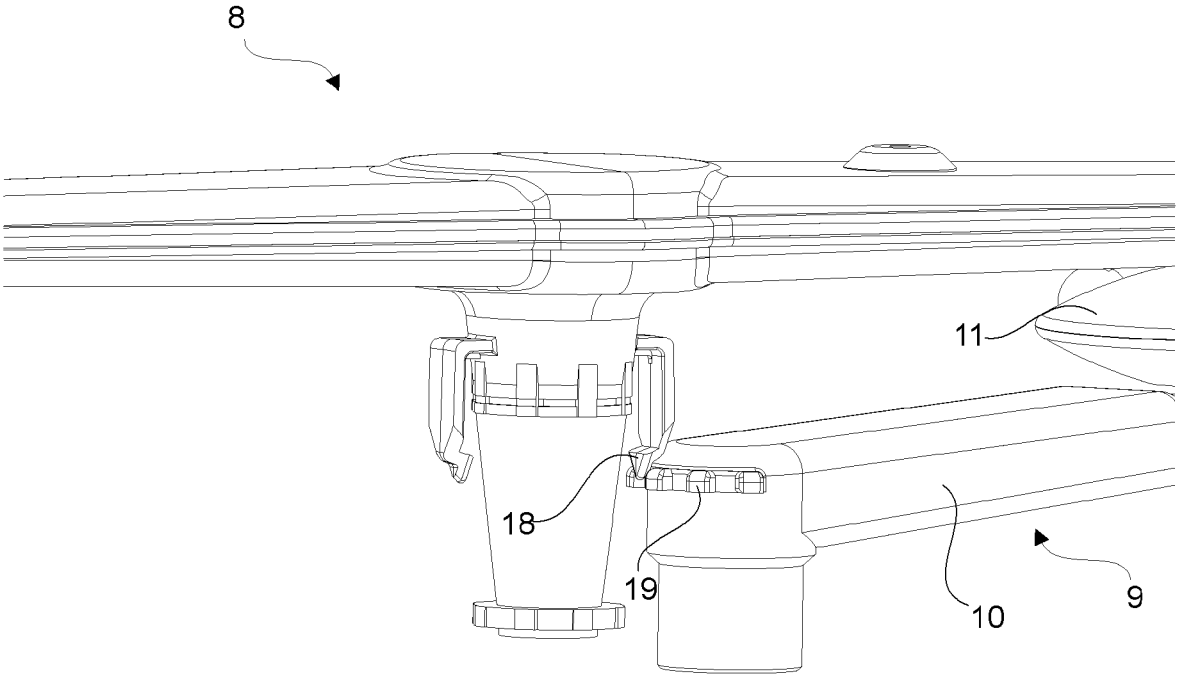

FIG. 7—is the partial view of the spray arm and the additional spray arm related to an embodiment of the present invention.

The elements illustrated in the figures are numbered as follows:

1. Dishwasher
2. Tub
3. Base
4. Rear wall
5. Side wall
6. Door
7. Rack
8. Spray arm
9. Additional spray arm
10. Transfer means
11. Headpiece
12. Hole
13. Outlet
14. Arm
15. Valve
16. Spraying hole
17. Barrier
18. Protrusion
19. Gear rack
20. Stopper The dishwasher (1) comprises a tub (2) having a base (3), a rear wall (4) and two side walls (5) surrounding the base (3); a door (6) providing access to the tub (2), connected to the tub (2) from its lower side and opening by tilting forward; a rack (7) having a washing position wherein it is placed on the base (3) so as to entirely remain inside the tub (2) and a loading position wherein it is positioned on the inner surface of the door (6) by being moved forward when the door (6) is open and wherein loading-unloading can be performed; and a spray arm (8) that remains under the rack (7) when the rack (7) is in the washing position and that sprays water into the rack (7) by rotating around itself.

The dishwasher (1) furthermore comprises an additional spray arm (9) that is disposed in the vicinity of the spray arm (8), that rotates around its axis for a limited distance as a result of the pressure of the water pumped thereinto and that sweeps a region of the rack (7) with water (FIG. 1, FIG. 2, FIG. 3, FIG. 4).

The door (6) is opened for loading the dishes to be washed into the rack (7) and the rack (7) is pulled outwards so as to be seated on the inner surface of the door (6). The rack (7) changed to the loading position is pushed forwards after loading the dishes to be washed therein and thus the rack (7) is placed into the tub (2). During the washing process, water is delivered to the spray arm (8) that is disposed under the rack (7) by means of the water line. The pressurized water delivered to the spray arm (8) from the water line is sprayed into the rack (7) via the spray arm (8). In addition to the water sprayed from the spray arm (8) to the rack (7), water is sprayed from the additional spray arm (9) that is preferably situated below the spray arm (8) in order to more efficiently wash the region of the rack (7) where extensively dirty dishes with respect to the others are placed. The additional spray arm (9) sweeps the said region in the rack (7) with water by making a partial rotational movement around the point whereto it is connected with the effect of the pressurized water delivered from the water line. Thus, dishes are enabled to be more efficiently washed by spraying water in efficient amount onto the said dishes.

In an embodiment of the present invention, the additional spray arm (9) comprises a transfer means (10) that extends outwards from the rotational axis of the additional spray arm (9) and that at least partially rotates around the axis whereto it is connected, and a headpiece (11) that is situated at the end of the transfer means (10), that rotates around its axis with the effect of the water and that sprays the water received from the transfer means (10) to the rack (7). Both the transfer means (10) and the headpiece (11) rotating enables the additional spray arm (9) to spray water to the region swept thereby in the rack (7) in a more efficient manner. The transfer means (10) radially rotates at an angle smaller than 180 degrees in a plane almost parallel to the base (3) and the headpiece (11) rotates a full turn around the axis whereto it is connected depending on the pressure of the water.

In an embodiment of the present invention, the additional spray arm (9) comprises a hole (12) that is arranged on the transfer means (10) so as to partially spray the water inside the transfer means (10) to the right or left side of the transfer means (10) and that enables the transfer means (10) to move in the reverse direction compared to the said sprayed water. By means of the hole (12) spraying water to the left side of the additional spray arm (9), the transfer means (10) rotates towards the right in accordance with the action-reaction principle. The said rotation accelerates depending on the pressure of the water.

In a derivative of this embodiment, the spray arm (8) comprises an outlet (13) that enables the water inside the spray arm (8) to be partially sprayed onto the additional spray arm (9) so that the additional spray arm (9) partially rotates around its axis. The additional spray arm (9), rotating for a certain distance with the water sprayed through the hole (12) on the transfer means (10), returns to its initial position after the water, that is sprayed through the outlet (13) while the spray arm (8) rotates with the pumping of water into the spray arm (8), hits the additional spray arm (9) and pushes the additional spray arm (9) (FIG. 6).

In a derivative of this embodiment, the spray arm (8) comprises two arms (14) that are situated on the spray arm (8), that extend in different directions and spray water into the rack (7). The outlet (13) is situated on the arm (14) so as to almost completely face the base (3). While rotating with the water sprayed through the hole (12), the additional spray arm (9) sweeps almost half of the rack (7) with the water sprayed through the headpiece (11) situated thereon and returns to its initial position by means of the water sprayed through the outlet (13).

In an embodiment of the present invention, the dishwasher (1) comprises a valve (15) that is situated on the water line delivering water to the spray arm (8) and the additional spray arm (9) and that directs water to the spray arm (8) and/or the additional spray arm (9). By means of the valve (15), water line supplies water to the spray arm (8) or the additional spray arm (9) as desired. While transferring water to the spray arm (8), the valve (15) cuts water transfer to the additional spray arm (9).

In an embodiment of the present invention, the additional spray arm (9) comprises at least two spraying holes (16) that are situated on the headpiece (11), that enable water to be sprayed from the headpiece (11) to the rack (7), that enable the headpiece (11) to rotate around its axis while spraying water into the rack (7) and that face opposite directions.

In an embodiment of the present invention, the additional spray arm (9) comprises a barrier (17) that is situated on the transfer means (10), that extends upwards from the transfer means (10) and that, with the effect of the water sprayed through the outlet (13) contacting thereon, enables the additional spray arm (9) to rotate. The additional spray arm (9) easily rotates by means of the barrier (17) that is situated at the upper portion of the transfer means (10) and that converts the force of the water sprayed through the outlet (13) to torque (FIG. 5).

In an embodiment of the present invention, the dishwasher (1) comprises at least one protrusion (18) that is situated on the spray arm (8) and a gear rack (19) that is situated on the transfer means (10) and that enables the transfer means (10) to rotate with the protrusion (18) contacting thereon during the rotation of the spray arm (8). The additional spray arm (9), that rotates for a certain distance by means of the water sprayed through the hole (12) arranged on the transfer means (10), returns to its initial position with the protrusions (18) contacting the gear rack (19) during the rotation of the spray arm (8) (FIG. 4, FIG. 7).

In an embodiment of the present invention, the spray arm (8) and the additional spray arm (9) operate alternately. While transferring water to the additional spray arm (9), the valve (15) cuts water transfer to the spray arm (8). After the additional spray arm (9) partially sweeps the rack (7) with water, the valve (15) cuts water transfer to the additional spray arm (9) and transfer water to the spray arm (8).

In an embodiment of the present invention, the dishwasher (1) comprises a stopper (20) that enables the rotational movement of the additional spray arm (9) to be terminated after the additional spray arm (9) contacts thereon. The rotational movement of the additional spray arm (9) ends as the additional spray arm (9) hits the stopper (20). In the dishwasher (1), two stoppers (20) are used with a distance therebetween, that limit the rotational movement of the additional spray arm (9) in both directions.

By means of the present invention, a dishwasher (1) is realized, having a spray arm (8) that sweeps almost the entire rack (7) and an additional spray arm (9) that partially sweeps the rack (7) and that enables the region in the rack (7), wherein extensively dirty dishes with respect to the others are placed, to be more efficiently washed.

The invention claimed is:

1. A dishwasher, comprising:

a tub including a base, a rear wall, and two side walls surrounding the base;

a door for providing access to the tub, wherein the door is connected to the tub from a lower side of the door, and wherein the door opens by tilting forward;

a rack having a washing position and a loading position, wherein, at the washing position, the rack is placed on the base so as to entirely remain inside the tub, wherein, at the loading position, the rack is positioned on an inner surface of the door by being moved forward when the door is open and wherein loading-unloading can be performed;

a first spray arm that remains under the rack when the rack is in the washing position, the first spray arm comprising an outlet angled toward a second spray arm that sprays water directed toward the second spray arm, wherein the first spray arm sprays water into the rack by rotating around a central axis; and the second spray arm that rotates around a rotational axis for a limited distance, wherein:

the second spray arm comprises a transfer means that extends outwards from the rotational axis, the transfer means comprises a barrier formed on an exterior of the transfer means, wherein the barrier extends upwards from the transfer means along a longitudinal length of the transfer means, the barrier is positioned such that the water that sprays from the outlet of the first spray arm directed toward the second spray arm contacts the barrier and the barrier converts a force of the water that contacts the barrier to torque for rotating the second spray arm around the rotational axis, the second spray arm further rotates around the rotational axis as a result of pressure of water pumped into the second spray arm, the second spray arm comprises a headpiece disposed at an end of the second spray arm, the headpiece rotates around a headpiece axis parallel to the rotational axis, the headpiece comprises at least two spraying holes that are disposed to enable the headpiece to rotate around the headpiece axis while spraying water into the rack, and the headpiece sweeps a region of the rack with at least a portion of the water.

2. The dishwasher as in claim 1, wherein the water is pumped through the transfer means and the transfer means rotates at least partially around the rotational axis, and wherein the headpiece is disposed at an end of the transfer means, wherein the headpiece sprays the at least the portion of the water received from the transfer means to the rack.

3. The dishwasher as in claim 2, wherein the transfer means comprises a hole arranged so as to partially spray the water inside the transfer means to a right or left side of the transfer means and that enables the transfer means to move in a reverse direction compared to the sprayed water.

4. The dishwasher as in claim 2, wherein the first spray arm comprises an outlet that enables water inside the first spray arm to be partially sprayed onto the second spray arm so that the second spray arm partially rotates around the rotational axis.

5. The dishwasher as in claim 2, wherein the first spray arm comprises two arms that extend in different directions and spray water into the rack, wherein at least one of the two arms comprise an outlet, wherein the region of the rack comprises less than half of the rack, and wherein the second spray arm returns to an initial position by means of water sprayed through the outlet.

6. The dishwasher as in claim 2, further comprising a water line that delivers the water to the first spray arm and the second spray arm, the water line comprising a valve that directs the water to the first spray arm and the second spray arm.

7. The dishwasher as in claim 2, wherein the at least two spraying holes face opposite directions.

8. The dishwasher as in claim 2, wherein the first spray arm comprises at least one protrusion and the second spray arm comprises a gear rack, wherein the gear rack contacts the at least one protrusion enabling the second spray arm to rotate during a rotation of the first spray arm.

9. The dishwasher as in claim 2, wherein the first spray arm and the second spray arm operate alternately.

10. The dishwasher as in claim 2, further comprising a stopper that terminates movement of the second spray arm around the rotational axis when the second spray arm contacts the stopper.

11. The dishwasher as in claim 1, further comprising a water line that delivers the water to the first spray arm and the second spray arm, the water line comprising a valve that directs the water to the first spray arm and the second spray arm.

12. The dishwasher as in claim 1, wherein the at least two spraying holes face opposite directions.

13. The dishwasher as in claim 1, wherein the first spray arm comprises at least one protrusion and the second spray arm comprises a gear rack, wherein the gear rack contacts the at least one protrusion enabling the second spray arm to rotate during a rotation of the first spray arm.

14. The dishwasher as in claim 1, wherein the first spray arm and the second spray arm operate alternately.

15. The dishwasher as in claim 1, further comprising a stopper that terminates movement of the second spray arm around the rotational axis when the second spray arm contacts the stopper.

* * * * *